United States Patent [19]

Smidt

[11] 4,022,359

[45] May 10, 1977

[54] LADLING APPARATUS

[76] Inventor: Glen R. Smidt, R.R. No. 1, Bangor, Mich. 49013

[22] Filed: Dec. 18, 1975

[21] Appl. No.: 641,899

[52] U.S. Cl. ..... 222/629; 164/336; 222/357

[51] Int. Cl.[2] ..... B22D 41/04

[58] Field of Search ..... 164/336; 222/357, 604, 222/356, 358, 166, 629

[56] References Cited

UNITED STATES PATENTS

| | | | |
|---|---|---|---|
| 3,393,837 | 7/1968 | Takeshima | 222/166 |
| 3,739,954 | 6/1973 | Blagg | 222/357 |
| 3,818,985 | 6/1976 | Smith | 164/336 X |

FOREIGN PATENTS OR APPLICATIONS

| | | | |
|---|---|---|---|
| 2,249,118 | 4/1974 | Germany | 164/336 |

*Primary Examiner*—Robert B. Reeves
*Assistant Examiner*—David A. Scherbel
*Attorney, Agent, or Firm*—Woodhams, Blanchard and Flynn

[57] ABSTRACT

A ladling apparatus for picking up a preselected amount of molten metal from a bath, and for transferring and pouring this molten metal into the cold chamber of a die casting machine. The apparatus includes an elongated transfer arm which is swingably movable within a substantially vertical plane between filling and pouring positions, in which positions the arm extends outwardly from opposite sides of the apparatus. A ladle assembly is hingedly mounted on the transfer arm adjacent the free end thereof. The ladle assembly is freely hinged in a suspended upright position when the arm is in the filling position and is maintained in this upright position as the arm swings toward the filling position. The ladle engages the arm, which acts as a solid stop and causes tilting of the ladle assembly, as the arm approaches its pouring position to result in automatic pouring of the molten metal into the cold chamber.

8 Claims, 10 Drawing Figures

LADLING APPARATUS

FIELD OF THE INVENTION

This invention relates to a ladling apparatus which permits a preselected amount of molten metal to be picked up from a bath of metal and then transferred and poured into the cold chamber of a die casting machine.

BACKGROUND OF THE INVENTION

The supplying of molten metal to a die casting machine and particularly the pouring of a preselected amount of molten metal into the cold chamber of a die casting machine has long been a problem in the die casting industry. The ladling of the molten metal from a bath, and then the transferring and pouring of the material into the die casting machine, has normally involved substantial manual manipulation so as to ensure that the molten metal is properly poured into the machine. However, this manual operation is obviously dangerous to the operating personnel in view of their exposure to the hot molten metal. This technique, which is necessarily relatively inefficient, also normally results in relatively inefficient use of material in that there is normally substantially spillage of molten metal. This manual operation also makes controlling the volume of molten metal which is to be supplied to the die casting machine extremely difficult, which in turn results in material wastage and/or improper die castings.

To overcome this problem, numerous attempts have been made at providing a machine which will automatically or substantially automatically transfer the molten metal from the bath to the die casting machine. However, to the best of my knowledge, all of these prior attempts have encountered various problems which have prevented a practical solution to this problem. For example, the prior devices have not permitted an efficient yet automatic transfer of this metal from the bath to the die casting machine without spillage and/or without requiring elaborate guide troughs and the like.

In one known apparatus, there is provided a swingable arm having a ladle mounted on the free end thereof, which ladle can be swingably moved from a position wherein it is immersed in a bath of molten metal to a position for pouring the metal into the cold chamber of a die casting machine. However, the ladle is fixed relative to the arm so that the ladle continuously tilts as the arm swings, whereupon pouring of metal from the ladle begins before the ladle is positioned over the cold chamber and continues over a substantial angular extent, thereby resulting in substantial spillage and hence wastage of the molten metal. This is obviously undesirable from both an economical and a safety standpoint.

To overcome these latter mentioned problems, a further apparatus is known wherein the ladle is interconnected to the swing arm by means of an intermediate linkage, such as a toggle arm, cams or the like. This linkage controls the tilting of the ladle only when the swing arm approaches the pouring position. However, this known apparatus is undesirable since this linkage substantially increases the mechanical complexity, weight and cost of the overall apparatus. This linkage has also been observed to seriously effect the mechanical dependability of the apparatus since the linkage normally involves a substantial number of hinge points which undergo rapid wear when utilized in this environment and when exposed to repetitive useage, which wear prevents free movement of the hinges and thus results in erratic pouring of the metal.

Thus, it is an object of the present invention to provide an improved ladling apparatus which overcomes the above-mentioned disadvantages.

Accordingly, the present invention provides an improved apparatus for permitting the automatic ladling of a molten metal from a bath, which apparatus then transfers the metal to the die casting machine and safely pours same into the machine. The apparatus of the present invention thus overcomes the above-mentioned disadvantages while at the same time it permits a precise quantity of molten metal to be efficiently and safely transferred between a bath and a die casting machine, while additionally permitting this metal to be poured directly into the machine without any appreciable spillage or splashing of the metal. This apparatus also permits the operator to control and stop the automatic operations of the machine while being located at a safe distance from the machine and from the molten metal so as to provide maximum operator safety yet efficient control over the transfer and pouring operations.

Other objects and purposes of the invention will be apparent upon reading the following specification and inspecting the accompanying drawings.

Figure 1:
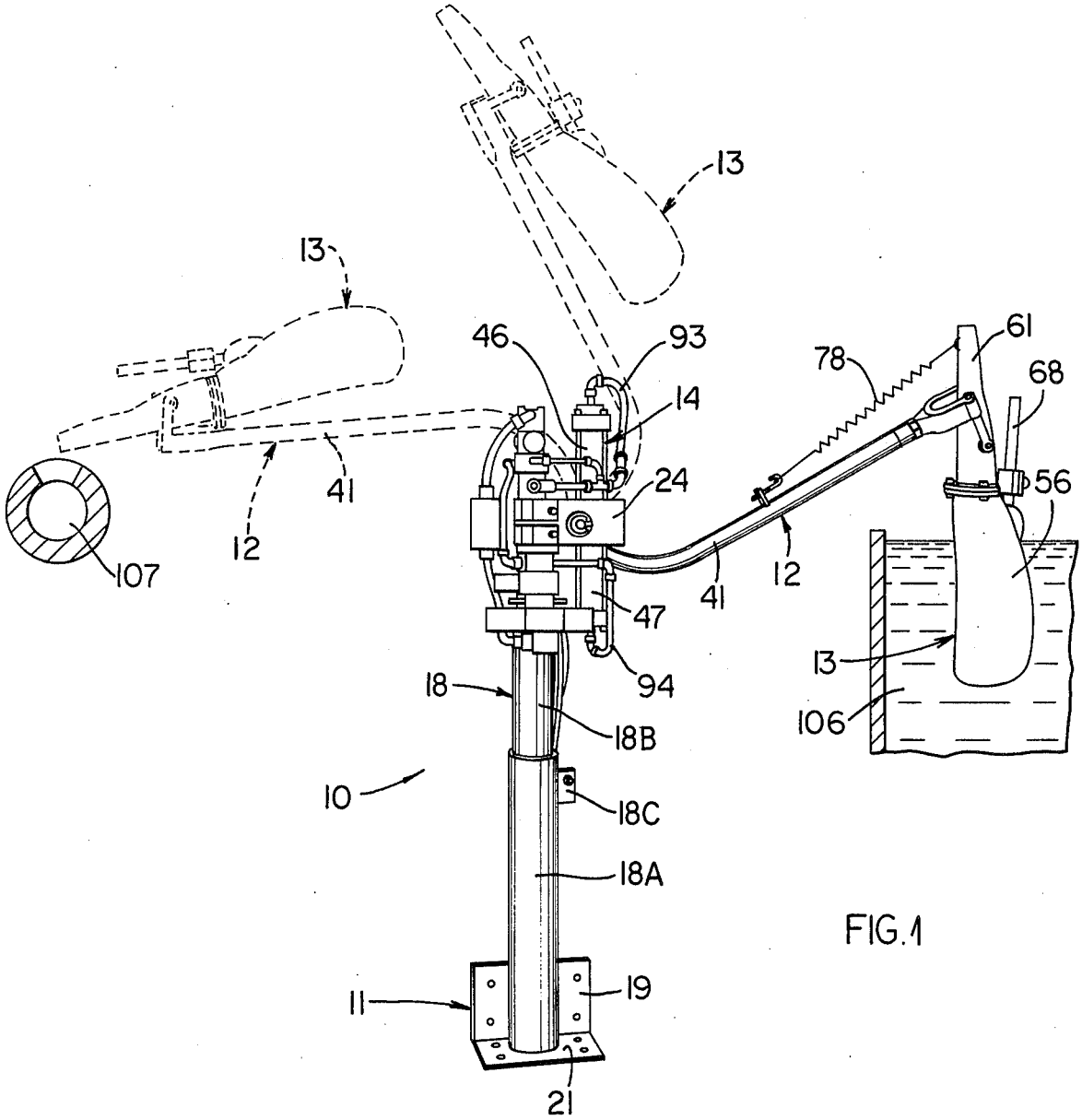
FIG. 1 is a perspective view of the ladling apparatus of the present invention.

Certain terminology will be used in the following description for convenience in reference only and will not be limiting. For example, the words "upwardly, downwardly, rightwardly" and "leftwardly" will refer to directions in the drawings to which reference is made. The word "forward" will refer to swinging movement of the ladle assembly in a direction for transferring molten metal from the bath to the die casting machine, which swinging movement occurs counterclockwise in FIG. 1, and the word "rearward" will refer to swinging movement in the opposite direction. The words "inwardly" and "outwardly" will refer to directions toward and away from, respectively, the geometric center of the apparatus and designated parts thereof. Said terminology will include the words specifically mentioned, derivatives thereof and words of similar import.

SUMMARY OF THE INVENTION

According to this invention, there is provided an apparatus having a frame which, in the disclosed embodiment, is formed as an upright pedestal. An elongated transfer arm is swingably mounted on the frame adjacent the upper end thereof for swinging movement within a substantially vertical plane about a substantially horizontal pivot axis. The transfer arm has a ladle assembly mounted on the free end thereof by means of a hinge structure which permits the ladle assembly to be suspended downwardly in an upright position for permitting the ladle assembly to be immersed into a bath of molten metal. The ladle assembly includes a bowl having a chamber of preselected size therein, which bowl has a pouring spout projecting upwardly from the open upper end thereof. A volume control bulb is adjustably positioned within the bowl to permit a precuse quantity of molten metal to be deposited therein. The transfer arm extends outwardly from one side of the apparatus when in a filling position to permit the bowl to be immersed in the bath. A drive mechanism causes the transfer arm to swing upwardly over the apparatus until the arm projects outwardly from the other side of the apparatus to permit pouring of the molten metal from the bowl into the die casting machine. During this swinging of the transfer arm between the filling and pouring positions, which swinging occurs through an angle of approximately 180°, the ladle remains in an upright and freely suspended position throughout a majority of the swinging movement of the transfer arm. The ladle assembly engages the arm and assumes a tilted position as the arm approaches the pouring position, so as to permit the automatic pouring of the molten metal into the pouring hole of the die casting machine. The drive mechanism includes opposed fluid pressure cylinders which cause forward and return swinging movement of the transfer arm, which cylinders are controlled by a suitable control circuit so as to control the speed of the swinging movement. The control circuit preferably utilizes the hydraulic system associated with the die casting machine.

DETAILED DESCRIPTION

Figure 9:
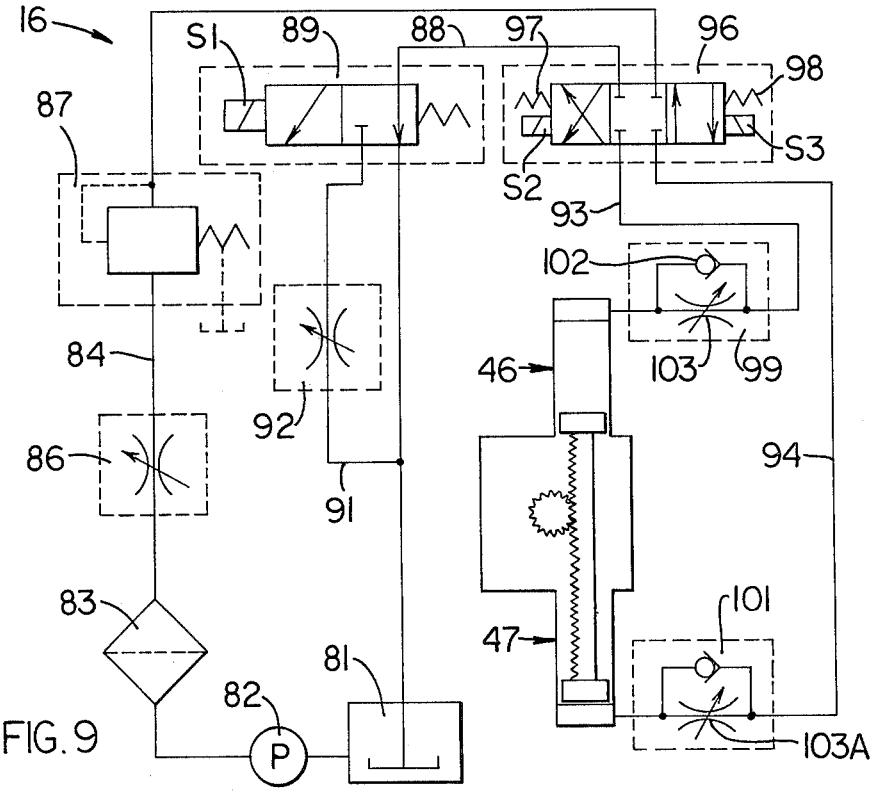
FIG. 9 illustrates the hydraulic control circuit.
Figure 10:
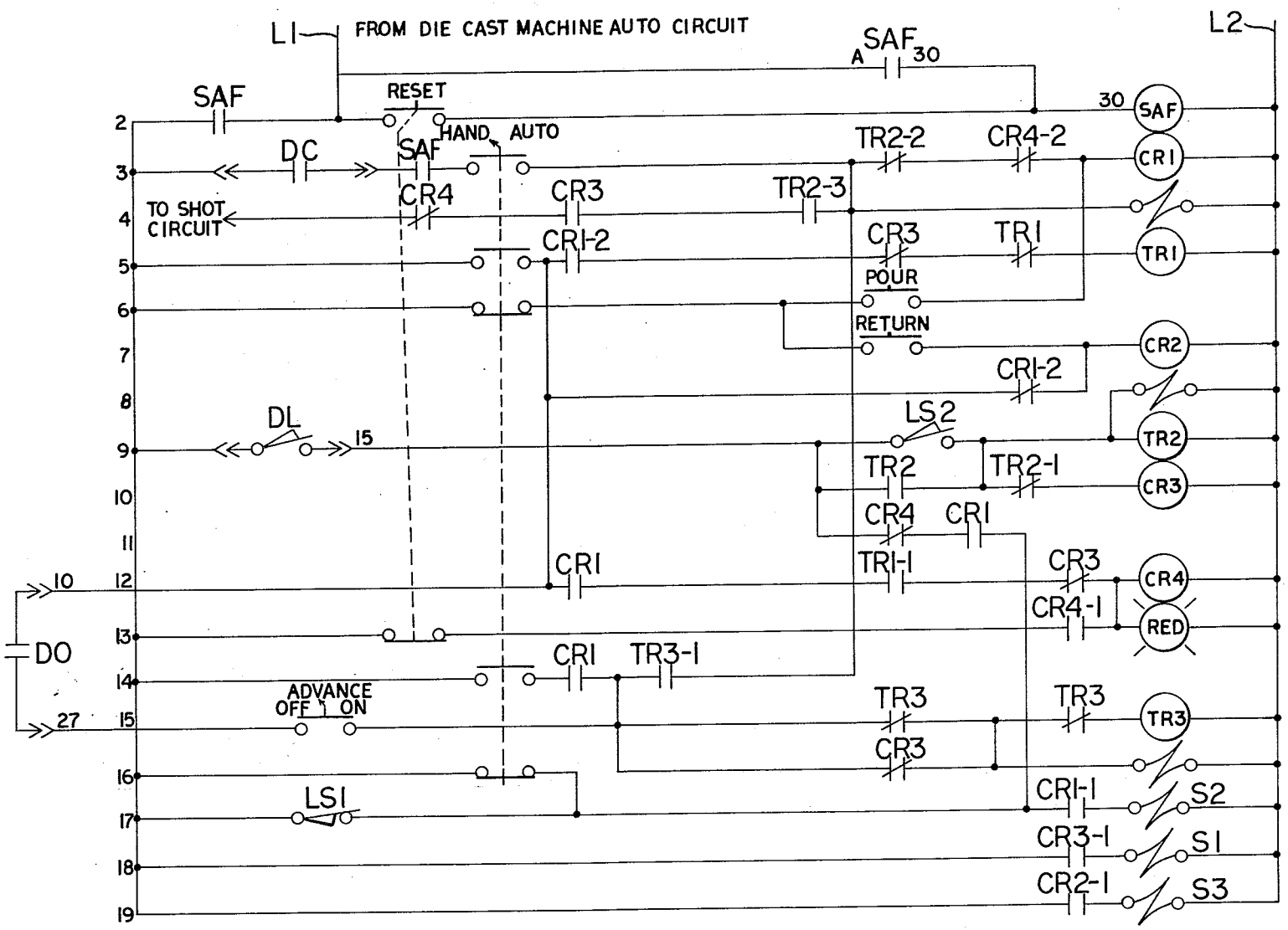
FIG. 10 illustrates the electrical control circuit.

Referring to FIG. 1, there is illustrated a ladling apparatus 10 which includes a frame 11 having a transfer arm 12 swingably mounted thereon. A ladle assembly 13 is mounted adjacent the free end of the arm 12, which arm is swingably moved by a drive mechanism 14. A fluid control system 16 (FIG. 9) and an electrical control system 17 (FIG. 10) are provided for controlling the apparatus.

The frame 11, in the illustrated embodiment, is formed by an upright pedestal 18 having mounting plates 19 and 21 fixedly secured to the lower end thereof, which mounting plates permit the frame to be bolted in an upright position. The pedestal 18 is preferably adjustable and, for this purpose, includes a lower tubular part 18A having an upper tubular part 18B slidably disposed therein, which parts are suitably fixedly connected by a releasable clamp 18C. Clamp 18C, when released, permits the upper pedestal part 18B to be raised or lowered, and also permits the part 18B to be rotated 360° so as to position the transfer arm 12 as desired.

Figure 4:
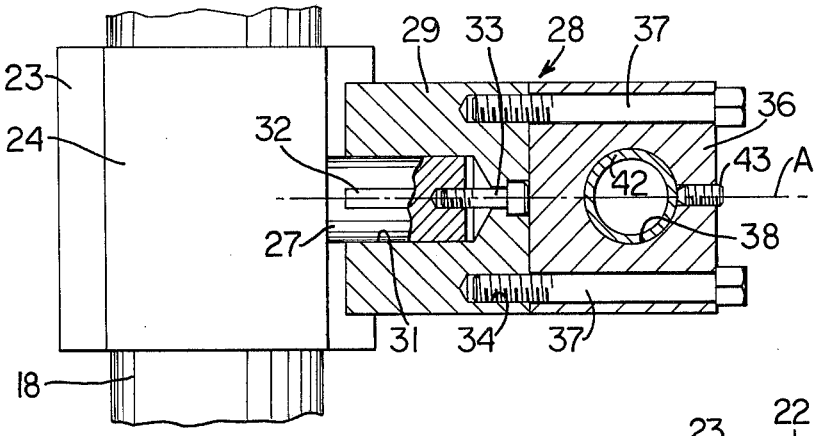
FIG. 4 is a fragmentary sectional view taken along line IV—IV in FIG. 3.

A mounting structure 22 (FIG. 2) is secured to the pedestal 18 adjacent the upper end thereof, which mounting structure includes a channel member 23 fixed to the pedestal, as by being welded thereto. The channel member 23 supports a bearing block 24, as by means of screws 26. The bearing block 24 rotatably supports a pivot shaft 27 which projects outwardly from one side of the bearing block and defines a substantially horizontal pivot axis A (FIG. 4).

An adjustable hub assembly 28 (FIG. 4) is provided for interconnecting the transfer arm 12 to the pivot shaft 27. This hub assembly includes an adapter sleeve 29 which has an opening 31 formed therein. Opening 31 receives the projecting end of the pivot shaft 27, with the shaft 27 and sleeve 29 being nonrotatably connected by a key 32. A screw 33 is also provided for securing the sleeve 29 to the shaft 27.

Figure 3:
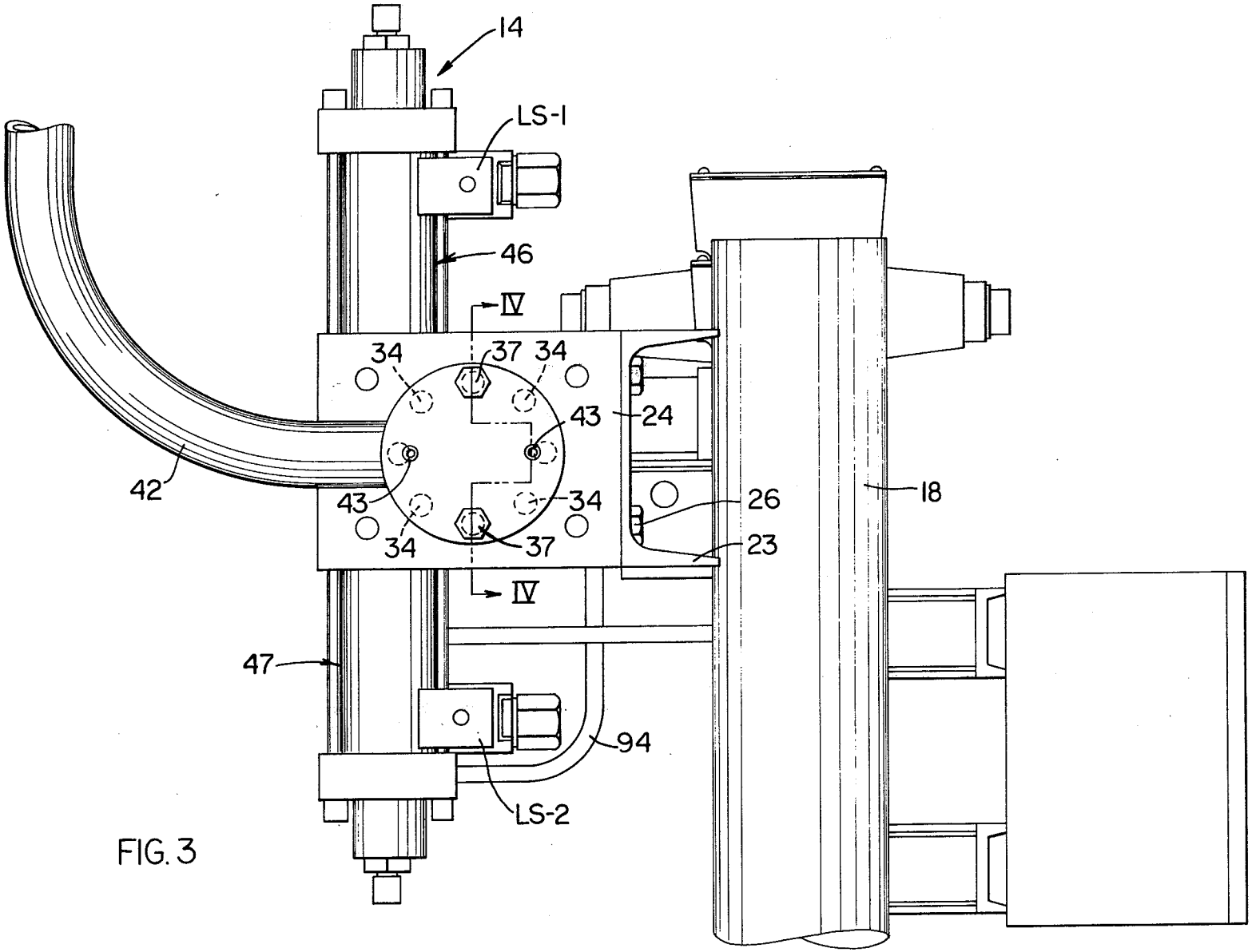
FIG. 3 is an enlarged fragmentary view illustrating the top of the ladling apparatus.

The sleeve 29 has several pairs of diametrically-opposed threaded openings 34 formed axially inwardly from the end face thereof. The pairs of openings 34 are disposed in angularly spaced relationship, there being four such pairs of openings 34 disposed at 45° angles as illustrated in FIG. 3. The openings 34 are provided for engagement with a pair of elongated screws 37, which screws permit a cylindrical support hub 36 to be fixedly secured to the adapter sleeve 29. The support hub 36 has a cylindrical opening 38 extending radially therethrough, which opening 38 has the axis thereof extending substantially perpendicular to and intersecting the pivot axis A.

The transfer arm 12 is, in the illustrated embodiment, of a substantially L-shaped configuration, such as by being formed from a piece of pipe, and thus has a long arm portion 41 and a short arm portion 42, which portions extend substantially perpendicular to one another. The short arm portion 42 extends through the opening 38 and is fixedly secured to the support hub 36 by a pair of set screws 43. The set screws 43 permit the short arm 42 to be slidably displaced within the opening 38 to thereby adjust the position of the arm as desired.

Considering now the drive mechanism 14, same includes a pair of opposed fluid pressure cylinders 46 and 47 (FIG. 2), which cylinders are mounted on and project outwardly from opposite sides of the bearing block 24. The cylinders 46 and 47 have pistons 48 and 49, respectively, slidably disposed therein. The pistons in turn are fixedly interconnected by an elongated gear rack 51 which extends through an enlarged cavity 52 formed in the bearing block 24. Gear rack 51 is disposed in meshing engagement with a pinion 53 which is fixedly secured to the pivot shaft 27. Each of the cylinders 46 and 47, which cylinders are single acting, has an adjustable screw 54 associated with the outer end thereof, which screw functions as a stop for determining the outermost position of the respective piston.

Referring now to the ladle assembly 13 as shown in FIGS. 5–8, same is mounted on the outer free end of the long arm portion 41 and includes a ladle 55 formed by an elongated hollow bowl 56 which is open at the upper end thereof. The bowl has an opening 57 formed in one side thereof, which opening extends downwardly through a substantial part of the overall length of the bowl. The bowl defines an interior cavity or chamber 58 therein of a predetermined volume, which chamber 58 determines the maximum quantity of molten metal which can be contained within the ladle assembly. The maximum volume of cavity 58 is determined by the lower edge 59 of the opening 57. The ladle also includes a channellike pouring spout 61 which is fixed to the upper end of the bowl 56 and forms an effective elongation of the bowl. The spout 61 and bowl 56 each have compatible mounting flanges 62 thereon which are disposed in abutting engagement and are fixedly interconected, as by volts 63.

The ladle assembly includes an L-shaped bracket 64 which is fixedly connected to the flanges 62 and has a clamp 66 mounted on the outer free end thereof. The clamp 66 comprises a split clamping member having an opening therethrough, which opening accommodates a rod 68. The rod 68 can be slidably displaced with respect to the clamping member 66, but can be fixed with respect thereto by means of a manually turnable tightening screw 67. The rod 68 has a displacement bulb 69 secured to the lower end thereof, which bulb extends into the bowl and is adapted to project into the chamber 58 so as to permit the volume of the chamber 58 to be selectively but precisely varied in accordance with the amount of molten metal which is to be supplied to the die casting machine.

Figure 5:
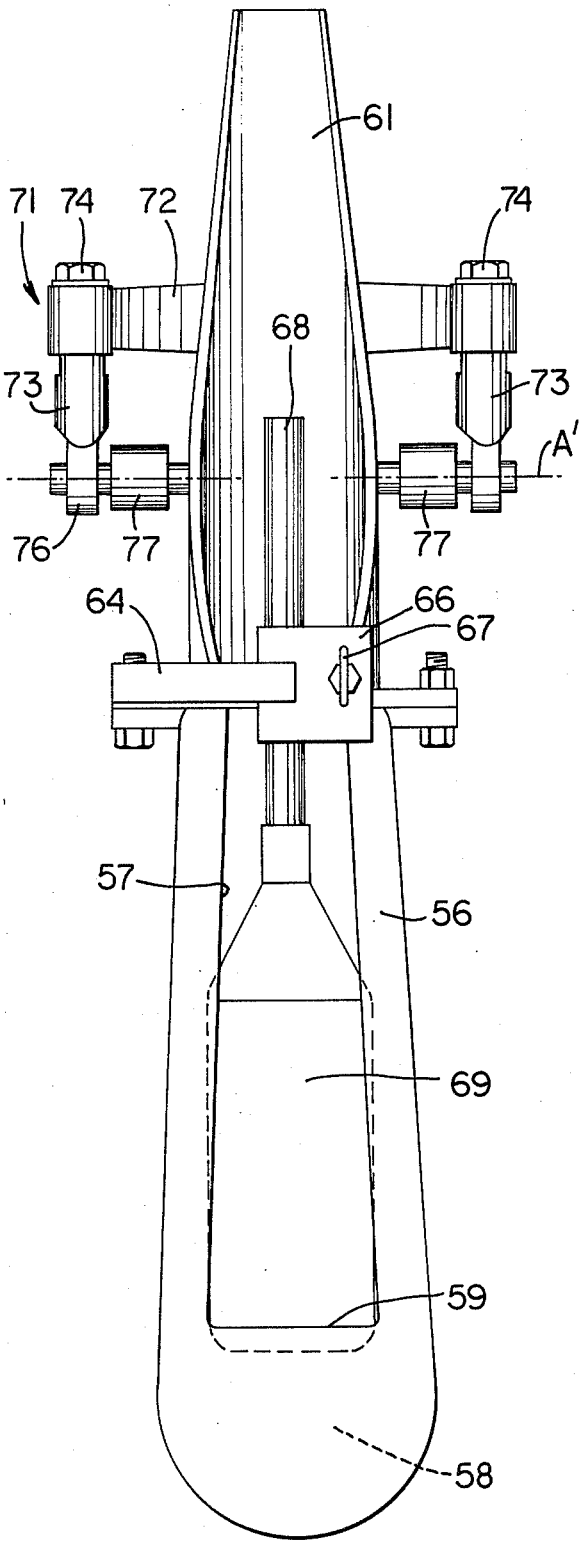
FIG. 5 is a front elevational view of the ladle assembly.
Figure 6:
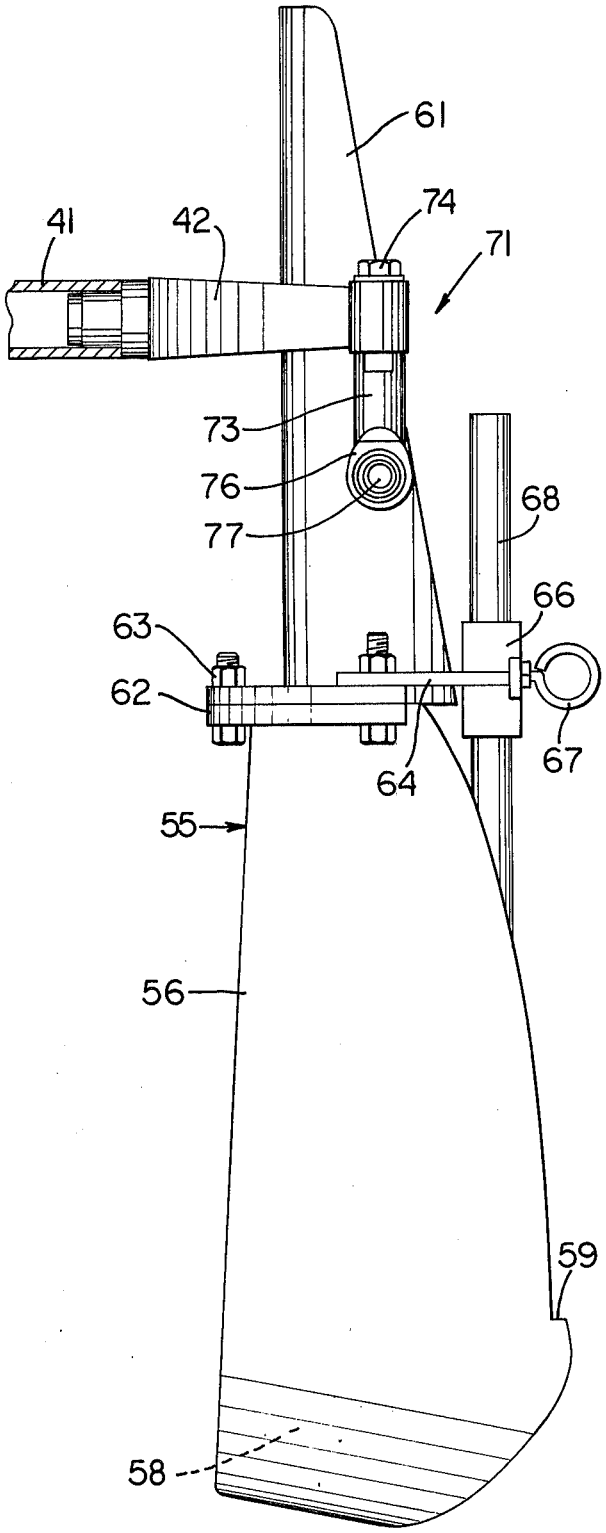
FIG. 6 is a side view of FIG. 5.
Figure 7:
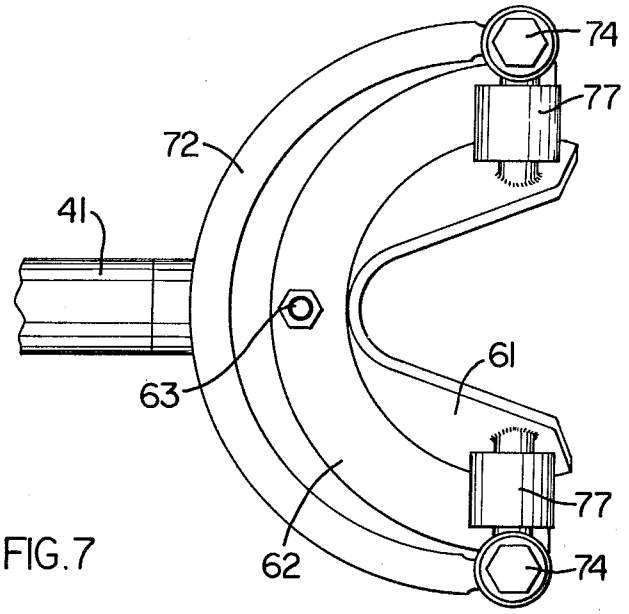
FIG. 7 is a fragmentary top view of FIG. 5.
Figure 8:
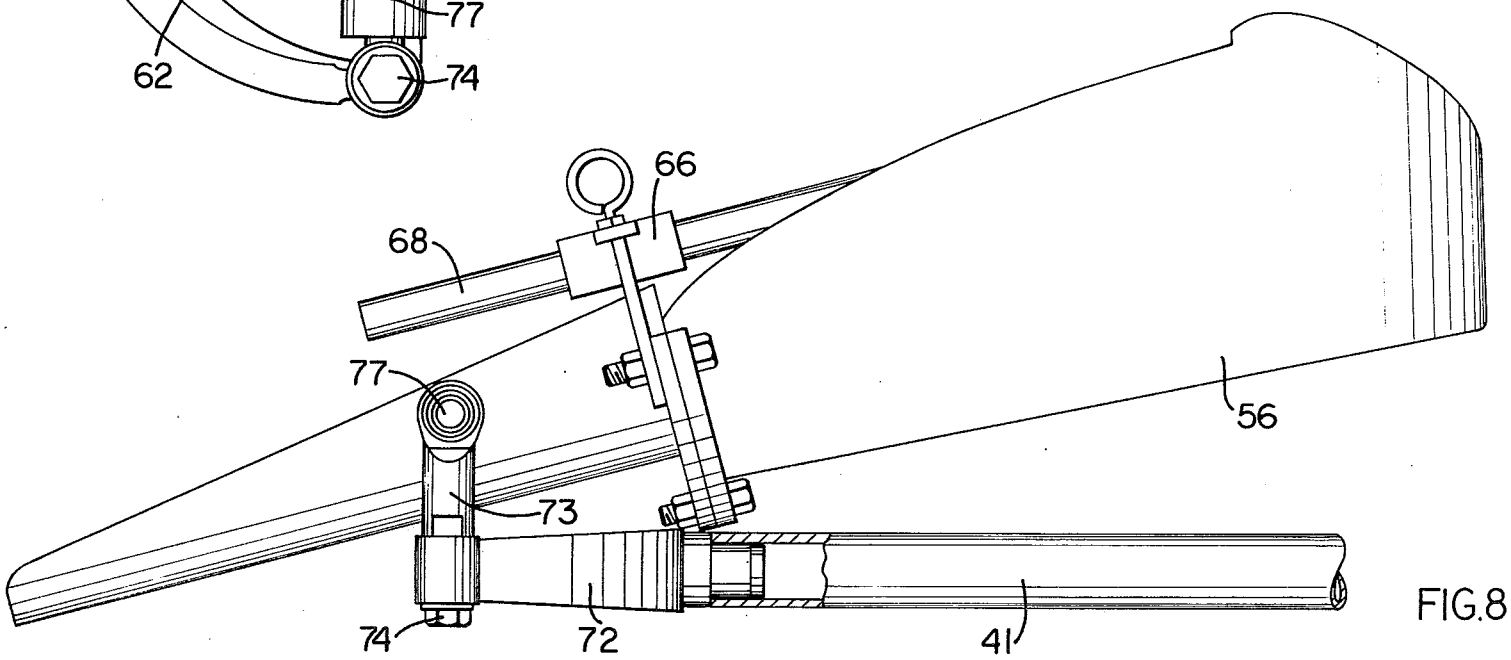
FIG. 8 shows the ladle assembly in a pouring position.

The ladle 55 is connected to the free end of the transfer arm 12 by a hinge or cradle structure 71 so as to permit the ladle to be maintained in an upright and freely suspended position (as shown in FIGS. 5 and 6) when the ladle is being filled and also during a major portion of the transfer movement of the ladle. For this purpose, the transfer arm 12 has a yoke member 72 fixedly secured to the outer end of the long arm portion 41. The yoke member 72 partially surrounds and straddles the spout 61. A pair of downwardly projecting arms 73 are fixedly secured, as by screws 74, to the free ends of the yoke 72. The arms 73 define, at their lower ends, a pair of aligned and opposed journal bearings 76. These journal bearings 76 in turn rotatably support a pair of opposed trunions 77 which are fixedly secured to and project outwardly from opposite sides of the spout 61.

A tension spring 78 has one end adjustably connected to the transfer arm 12 and the other end anchored to the spout 61, as shown in FIG. 1. This spring 78 is relatively weak so that it is unable to overcome the weight of the ladle assembly, whereupon the ladle assembly will freely assume its upright suspended position as shown in FIG. 1. The spring 78 does, however, effectively dampen the angular oscillation of the ladle during swinging movement of the arm, which oscillation has been observed to occur when the ladle is lifted upwardly out of the bath.

To control the swinging movement of the transfer arm 12 between a filling position (shown by solid lines in FIG. 1) wherein the arm projects outwardly from one side of the apparatus, and a pouring position wherein the arm projects outwardly from the other side of the apparatus (as illustrated by leftwardmost dotted line position in FIG. 1), there is provided the fluid control system 16 (FIG. 9) for controlling the energization of the pressure cylinders 46 and 47. This control system 16 normally utilizes an incompressible operating fluid, such as hydraulic fluid. This fluid is stored in a tank or reservoir 81 and is pressurized by a conventional pump 82, whereupon the pressure fluid flows through a filter 83 into a main supply conduit 84, which conduit has a conventional adjustable flow control valve 86 associated therewith, such as an adjustable needle valve. A conventional pressure reducing valve 87 is also associated with the conduit 84, whereupon the valves 86 and 87 permit control over the flow and/or pressure of the fluid supplied through the conduit 84.

The control system 16 also includes a main drain or discharge conduit 88 which is connected to the tank 81. This discharge conduit 88 has a conventional two-way flow control valve 89 associated therewith, which valve in a conventional manner is normally urged in one position by means of a spring, and can be urged into its other position by means of an electrical solenoid S1. When the solenoid S1 is energized, this permits the conduit 88 to be connected to an auxiliary conduit 91 which has a conventional adjustable flow control valve 92 associated therewith for controlling the flow of pressure fluid to the tank 81.

The supply and drain conduits 84 and 88 are adapted to be connected to a pair of further conduits 93 and 94, which conduits are respectively connected to the pressure cylinders 46 and 47 for permitting pressure fluid to be supplied to or removed from these cylinders. A four-way valve assembly 96 interconnects the cylinder conduits 93 and 94 to the supply and drain conduits 84 and 88. The four-way valve assembly 96 is normally maintained in a fully closed position, but possesses a pair of electrical solenoids S2 and S3 which permit shifting of the valve spool in opposite directions so that the supply conduit 84 can be selectively connected to cylinder conduit 93 when solenoid S2 is energized, whereas supply conduit 84 is connected to cylinder conduit 94 when solenoid S3 is energized. Spring 97 and 98 always return the valve assembly into its closed position when both of the solenoids are deenergized.

The cylinder conduit 93 has a combined flow control and check valve assembly 99 associated therewith, and the other cylinder conduit 94 similarly has a combined flow control and check valve assembly 101 associated therewith. The valve assemblies 99 and 101 are identical in that each includes a one-way check valve 102 connected in parallel with an adjustable flow control valve 103, such as an adjustable needle valve. The check valve 102 permits unrestricted flow of fluid through the associated conduit into the respective cylinder but prevents flow of fluid from the cylinder. Flow of fluid from the cylinder, as when the fluid is being supplied to the drain conduit, is permitted by the adjustable flow control valve 103, which thus restricts or controls the drainage of fluid from the cylinder and thereby controls the speed of movement of the pistons and hence the speed of movement of the gear rack 51.

The tank 81 and pump 82 are normally associated with the die casting machine, and can thus be used for controlling the ladling apparatus 10.

The fluid pressure cylinders 46 and 47 have limit switches LS1 and LS2 associated therewith, as shown in FIG. 3, which switches comprise conventional magnetic reed switches activated by a magnetic band 104 associated with each of the pistons 48 and 49. These switches assist in controlling the swinging of the transfer arm, as explained hereinafter. Conventional mechanical limit switches could also be utilized in place of the magnetic switches, if desired.

While not shown in the drawings, the ladling apparatus is preferably provided with a control panel mounted on a separate pedestal which is spaced from the ladling apparatus so as to permit an operator to control the movements of the ladle. This control panel contains the electrical control components and circuitry, as diagrammatically illustrated in FIG. 10.

OPERATION

Figure 2:
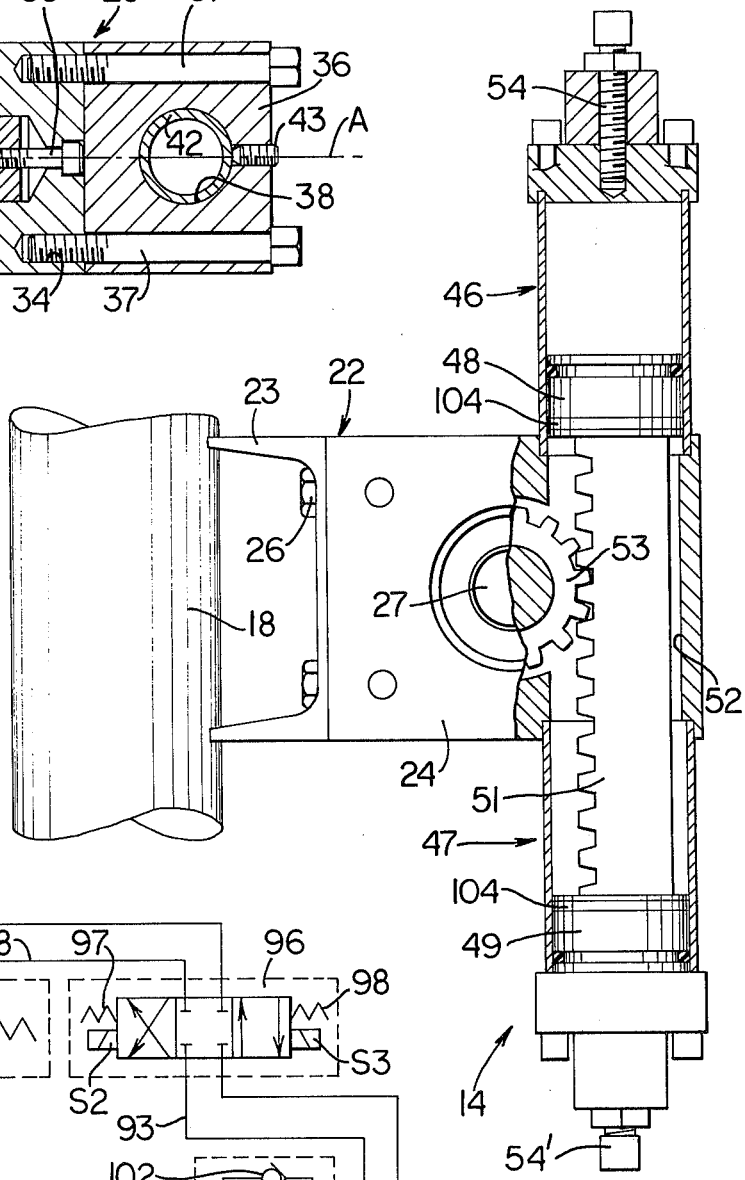
FIG. 2 is an enlarged, fragmentary sectional view illustrating the drive mechanism for the transfer arm.

In operation, and assuming that the ladle 55 is immersed in a bath of molten metal, such as the bath 106 shown in FIG. 1, then the drive mechanism 14 will be in the position illustrated in FIG. 2. Upon energization of the solenoid S2, the valve 96 is shifted to connect supply conduit 84 to cylinder conduit 94, and simultaneously cylinder conduit 93 is connected to drain conduit 88. Pressure fluid is thus supplied to the lower end of cylinder 47 so that pistons 48, 49 and gear rack 51 are moved upwardly, thereby rotating gear 53 and swinging arm 12 away from its filling position (counterclockwise in FIG. 1). The speed of swinging movement of arm 12 is controlled by the rate at which fluid escapes from the upper cylinder 46, which rate is controlled by the adjustable needle valve 103 associated with the valve assembly 99. Controlling the piston speed by controlling the drainage of fluid from the inactive cylinder is highly desirable since, when the transfer arm passes over its uppermost position and begins to swing in a downward direction, the restricted drainage of pressure fluid from the inactive cylinder 46 provides precise control over the swinging movement of the arm as it approaches its pouring position.

During swinging movement of the arm from the filling position into an intermediate position similar to that illustrated by dotted lines in FIG. 1, the ladle 55 remains in a suspended and upright position. However, upon reaching this intermediate position, the ladle and arm engage one another so that further swinging movement of the arm toward the pouring position results in a gradual tilting of the ladle until the ladle is in a pouring orientation substantially simultaneously with an arm reaching its pouring position, as shown by the leftwardmost dotted position in FIG. 1. Thus, the metal does not begin to pour from the ladle until the arm is positioned closely adjacent and substantially over the cold chamber 107 of the die casting machine. As the arm 12 undergoes the last small amount of angular swinging movement, which swinging movement occurs over only a small number of degrees, then the molten metal in the ladle is safely poured into the cold chamber.

When the arm 12 is swinging toward the cold chamber and is disposed closely adjacent the pouring position, then the solenoid S1 is activated so that valve 89 is shifted to connect drain line 88 to auxiliary drain line 91. The adjustable needle valve 92 thus imposes a further restriction on the discharge of pressure fluid so that the rate of movement of pistons 48 and 49 is further restricted, whereupon the arm 12 moves at a slower rate just before reaching the pouring position. The angular movement of the arm thus occurs slowly to thereby facilitate the proper pouring of the molten metal from the ladle into the cold chamber.

After the molten metal has been poured into the cold chamber, the solenoids S1 and S2 are deenergized, and the solenoid S3 is then energized to thereby connect supply conduit 84 to cylinder conduit 93 which also results in cylinder conduit 94 being connected to drain conduit 88. Pressure fluid is thus supplied to the upper end of cylinder 46, which moves pistons 48, 49 downwardly so that arm 12 is swung (clockwise in FIG. 1) toward the filling position. The speed of swinging movement of arm 12 during this return movement is controlled by the drainage of the pressure fluid through the adjustable needle valve 103A associated with the flow control valve assembly 101.

The following is a more detailed description of the automatic operation of the ladling apparatus, and its relationship with the die casting machine.

The control circuit 17 (FIG. 10) for the ladling apparatus is connected to the electrical circuit for the die casting machine so that electrical power will be available across the lines L1 and L2 only when the die casting machine is energized so as to be in its automatic mode of operation. With the die casting machine so energized, electrical potential will be available for connection between the lines L1 and L2. However, in view of the presence of the safety relay SAF, together with the normally-open RESET button as provided on the control panel, the control circuit 17 is normally maintained in a deenergized condition.

Under normal operation, the AUTO push button is depressed and locked in a closed position so as to permit automatic operation of the ladling apparatus. Further, to permit an automatic yet maximum die casting rate, the ADVANCE button is depressed and locked in an "on" or closed position. With the control system 17 in this condition, a ladling and die casting operation can be initiated by the operator momentarily pushing the RESET button into its closed position, which in turn results in energization of the safety relay coil SAF, so that the relay switches associated therewith are thereby closed. When the die casting machine is activated by the operator so as to result in movement of the die assembly toward its closed position, then this results in closure of the die closing limit switch DC, which in turn results in energization of the relay coil CR1. This causes relay switch CR1-1 to close so that solenoid S2 is energized, whereupon the arm 12 is swung upwardly out of the bath and away from the filling position substantially as described above. Energization of relay coil CR1 also closes the relay CR1-2 whereby timer TR1 is energized at the time arm 12 starts to swing upwardly away from the filling position.

As the arm swings away from the filling position toward the pouring position, the piston associated with the cylinder 46 moves into a position adjacent the limit switch LS1 and causes same to open, whereupon solenoid S2 is deenergized so that arm 12 stops in an intermediate position, such as the intermediate dotted line position shown in FIG. 1. The arm and ladle assembly will be maintained in this intermediate position either until the die assembly locks in its closed position, which causes closure of the die lock limit switch DL, or until the timer TR1 times out.

If the timer TR1 times out prior to closure of the die lock limit switch DL, then this results in the switch contact TR1-1 closing so that relay coil CR4 is energized, whereupon its switch contacts CR4-1 are closed so that relay CR-4 is thus continuously energized and the light RED is thus energized so as to indicate the necessity of having to reset the control system.

Energization of relay coil CR4 also causes opening of relay switch CR4-2, so that relay coil CR1 is deenergized. This results in a reclosing of relay switch CR1-2 so that relay coil CR2 is energized, whereupon relay switch CR2-1 closes and energizes the return solenoid S3. Cylinder 46 is thus energized and causes a return swinging movement of the arm so that the ladle is returned to the bath. When the ladle is returned to the bath, the swinging movement of the arm is stopped due to the piston 49 engaging the adjustable top screw 54'.

On the other hand, if the die assembly locks in position prior to timing out of the timer TR1, then the die lock limit switch DL is closed so that solenoid S2 is again energized and the forward swinging movement of the arm 12 toward the pouring position resumes. As the arm 12 closely approaches the pouring position, the piston associated with the cylinder 47 encounters and closes the limit switch LS2 is closed, which in turn energizes timer TR2 and also energizes relay coil CR3. This results in relay contact CR3-1 being closed so that solenoid S1 is energized, whereupon the escape of fluid to the drain is further restricted by the flow control valve 92 and thus results in the last increment of arm movement being at a slower rate to facilitate the pouring of molten metal into the cold chamber 107. The forward movement of the arm is again limited by the solid stop defined by the screw 54.

When the timer TR2 times out, the timer relay switch TR2-1 opens so that relay coil CR3 is deenergized. The timer relay switch TR2-2 is also opened so that relay coil CR1 is also deenergized. The relay switches CR1-1 and CR3-1 are thus opened, so that solenoids S1 and S2 are deenergized. Deenergization of relay CR1 also results in closure of relay switch CR1-2 so that relay coil CR2 is energized, whereupon relay switch CR2-1 is closed and solenoid S3 is energized. Fluid is thus applied to cylinder 46, thereby resulting in a returning swinging movement of the arm until the ladle is again immersed in the bath.

The timing out of timer TR2 also momentarily closes switch TR2-3 so that the "shot circuit" of the die casting machine is energized, whereby the metal is injected in the die in a conventional manner.

With the ADVANCE switch in its "on" or closed position, then the timer TR3 will be energized when the die assembly is returned to its open position, in which position the normally open limit switch DO is closed. The timer TR3 will thus maintain the ladle in the bath for a preselected time interval, whereupon when the timer TR3 times out, the timer relay switch TR3-1 closes so that relay coil CR1 is again energized, thereby closing relay contact CR1-1 and causing energization of solenoid S2 so that the arm and ladle are swung upwardly and outwardly away from the filling position until reaching the intermediate position, whereupon the arm is stopped in the manner described above. In this manner, an automatic cycling of the arm and ladle assembly, in correspondence with the movement with the die assembly, is thus achieved.

If the ADVANCE button is maintained in its "off" position, in which position its switch is open, then the ladle will remain in its filling position and will not leave this position until the die closing limit switch DC is closed.

When the AUTO switch is moved into an open position, then this prevents the automatic operation of the ladling apparatus. Operation of the arm can then be controlled manually by closing either the POUR or RETURN switches. These latter-mentioned switches must be manually held in their closed positions in order to permit forward or return swinging movement of the arm.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A ladling apparatus for picking up and transferring a preselected amount of a flowable fluid material, comprising:

a frame means;

transfer arm means mounted on said frame means for swinging movement within a substantially vertical plane between filling and pouring positions, said transfer arm means projecting outwardly from one side of said frame means when in said filling position and projecting outwardly from the other side of said frame means when in said pouring position;

drive means interconnected to said transfer arm means for causing swinging movement of said arm means between said filling and pouring positions;

a ladle assembly mounted on said arm means adjacent the free end thereof, said ladle assembly including a bowllike ladle member defining an upwardly opening chamber therein of predetermined volume when said ladle member is in an upright position;

hinge means connecting said ladle member to said transfer arm means for permitting relative swinging movement between said ladle member and said arm means, said hinge means permitting said ladle member to be maintained in a suspended upright position when said arm means is in said filling position, said hinge means also maintaining said ladle member in an upright suspended position as said arm means is swingably moved away from said filling position into an intermediate position which is located between said filling and pouring positions but is substantially spaced from said filling position; and stop means coacting between said arm means and said ladle assembly as said arm means is swingably moved from said intermediate position toward said pouring position for causing said ladle member to be tilted into a pouring orientation as said arm means approaches said pouring position.

2. An apparatus according to claim 1, wherein said arm means is swingably mounted with respect to said frame means about a first substantially horizontally extending pivot axis, and wherein said hinge means permits swinging movement of said ladle assembly relative to said arm means about a second substantially horizontal pivot axis which is substantially parallel to but substantially spaced from said first pivot axis.

3. An apparatus according to claim 2, wherein said ladle assembly includes means associated therewith and cooperating with said ladle member for adjusting the volume of said chamber.

4. An apparatus according to claim 3, wherein said ladle member is open at the upper end thereof when in said upright position, and wherein said ladle member has an opening projecting downwardly along one side thereof and terminating at a location spaced upwardly from the lower end of said ladle member when same is in said upright position, and said ladle assembly including a channellike spout fixedly secured to the open upper end of said ladle member.

5. An apparatus according to claim 4, wherein said drive means includes fluid pressure cylinder means having a reciprocating drive member and force transmitting means drivingly connected between said reciprocating drive member and said transfer arm means for causing angular swinging movement of said transfer arm means in response to linear movement of said drive member.

6. An apparatus according to claim 1, including support shaft means connected to the inner end of said transfer arm means for swingably supporting said transfer arm means on said frame means for swinging movement about a substantially horizontal pivot axis, said support shaft means including a rotatable pivot shaft defining a pivot axis, and said drive mechanism being drivingly interconnected to said pivot shaft for causing rotation thereof, said drive means including fluid pressure cylinder means drivingly interconnected to said pivot shaft.

7. An apparatus according to claim 6, wherein said drive means includes a gear fixed to said pivot shaft for rotation therewith, and said fluid pressure cylinder means including first and second fluid pressure cylinders disposed in aligned but opposed relationship, said first and second cylinders having pistons which are fixedly interconnected by an intermediate gear rack, said gear rack being meshingly engaged with said gear for causing rotation of said pivot shaft in response to movement of said pistons.

8. A ladling apparatus for picking up and transferring a preselected amount of a flowable fluid material, comprising:

a frame means;

transfer arm means mounted on said frame means for swinging movement within a substantially vertical plane between filling and pouring positions, said transfer arm means projecting outwardly from one side of said frame means when in said filling position and projecting outwardly from the other side of said frame means when in said pouring position;

drive means interconnected to said transfer arm means for causing swinging movement of said arm means between said filling and pouring positions;

a ladle assembly mounted on said arm means adjacent the free end thereof, said ladle assembly including a bowllike ladle member defining an upwardly opening chamber therein of predetermined volume when said ladle member is in an upright position;

hinge means connecting said ladle member to said transfer arm means for permitting relative swinging movement between said ladle member and said arm means, said hinge means permitting said ladle member to be maintained in a suspended upright position when said arm means is in said filling position, said hinge means also maintaining said ladle member in an upright suspended position during a substantial portion of the swinging movement of said arm means away from said filling position toward said pouring position;

support shaft means connected to the inner end of said transfer arm means for swingably supporting said transfer arm means on said frame means for swinging movement about a substantially horizontal pivot axis, said support shaft means including a rotatable pivot shaft defining said pivot axis;

said drive means being drivingly interconnected to said pivot shaft for causing rotation thereof, said drive means including fluid pressure cylinder means drivingly interconnected to said pivot shaft; and adjustment means associated with said support shaft means for permitting the position of said transfer arm means to be selectively varied with respect to said pivot shaft.

* * * * *